US005203858A

United States Patent [19]

Seymour-Chalk

[11] Patent Number: 5,203,858

[45] Date of Patent: Apr. 20, 1993

[54] ALTERNATING VELOCITY ROTARY ENGINE EMPLOYING A GEAR CONTROL MECHANISM

[76] Inventor: Hugh A. Seymour-Chalk, 93 Canfield Gardens, London, United Kingdom, NW6 3EA

[21] Appl. No.: 825,935

[22] Filed: Jan. 27, 1992

[51] Int. Cl.[5] ..... F01C 1/077

[52] U.S. Cl. ..... 418/36

[58] Field of Search ..... 418/36; 123/245

[56] References Cited

U.S. PATENT DOCUMENTS

| | | | |
|---|---|---|---|
| 2,503,894 | 4/1950 | Wildhaber | 418/36 |
| 3,801,237 | 4/1974 | Gotthold | 418/36 |
| 4,084,550 | 4/1978 | Gaspar | 418/36 |
| 4,788,952 | 12/1988 | Schonholzer | 418/36 |

FOREIGN PATENT DOCUMENTS

| | | |
|---|---|---|
| WO86/01255 | 2/1986 | PCT Int'l Appl. . |
| 1124509 | 8/1968 | United Kingdom . |
| 1419043 | 12/1975 | United Kingdom . |
| 1449733 | 9/1976 | United Kingdom . |

*Primary Examiner*—John J. Vrablik

*Attorney, Agent, or Firm*—Merchant & Gould, Smith, Edell, Welter & Schmidt

[57] ABSTRACT

An alternating velocity rotary engine including a pair of pistons 1 connected to main shaft 6 through an alternating velocity mechanism 5 in which the mechanism employs for each piston a rotary drive gear element 11 which cooperates with a further gear element 12, an eccentrically disposed drive element 15 on the rotary gear element and means 4, 16 and 17 drivingly to connect the piston 1 to the drive element 15.

5 Claims, 6 Drawing Sheets 11
12
15
1
90°
3a
3b
0°
180°

ALTERNATING VELOCITY ROTARY ENGINE EMPLOYING A GEAR CONTROL MECHANISM

The present invention relates to rotary engines of the alternating velocity type.

Rotary engines of this type are known. Such engines have a toroidal shaped channel in which usually two pairs of pistons are arranged. Each pair of pistons comprises two diametrically opposed pistons, and each pair is mounted on a separate rotor. The rotors are arranged to rotate in such a manner that the speed of each piston pair continuously changes so that the relative position of the piston pairs, and hence the volume of the chambers defined between adjacent pistons, continuously changes. Both rotors are coupled to a main shaft which is rotated as a result of movement of the pistons due to ignition of a charge in the chambers.

Rotary engines of the type described above are arranged to complete two full "four stroke" cycles in a single rotation of a given piston. Thus to provide the same power as an equivalent "four stroke" engine, it is only necessary for the engine shaft to rotate at half the speed of the crankshaft of a conventional engine.

A problem with such engines is in obtaining the continuously changing angular velocities of the piston pairs and the corresponding relative positions. One solution which has been proposed involves the use of elliptically shaped gears with each pair of gears connected to a respective rotor. However, this has the problem that such gears are susceptible to tooth damage during use and therefore such an arrangement is not practical.

According to the present invention, in an alternating velocity rotary engine including a pair of pistons connected to an engine main shaft through an alternating velocity mechanism, the mechanism employs for each piston, a rotary drive gear element which cooperates with a further gear element, an eccentrically disposed drive element on the rotary drive gear element and means drivingly to connect the piston to the drive element.

Each drive gear may rotate on an axis extending radially from the engine main shaft.

Each eccentrically mounted drive element may be connected to a piston shaft extension by a connecting arm rotatably connected to the drive element, which connecting arm extends to, and is rotatably connected to, the piston shaft extension.

The drive gear elements, the further gear element, the connecting arms, the piston shaft extensions and a main shaft enlargement may have spherical surfaces with a common centre point on the main shaft axis.

Preferably the engine includes two pairs of pistons with the pistons of each pair mounted on a common rotor connected to a respective alternating velocity mechanism.

Figure 1:
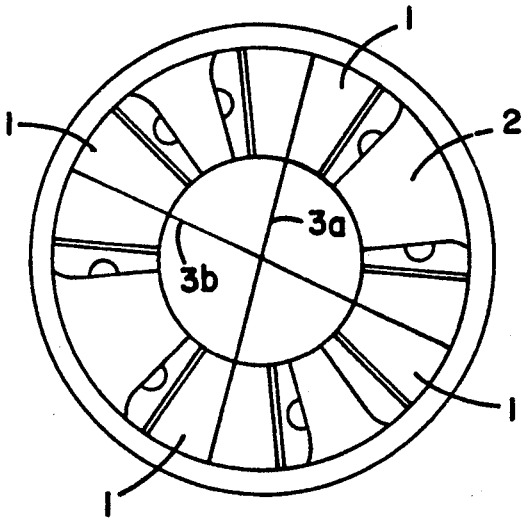
Figure 2:
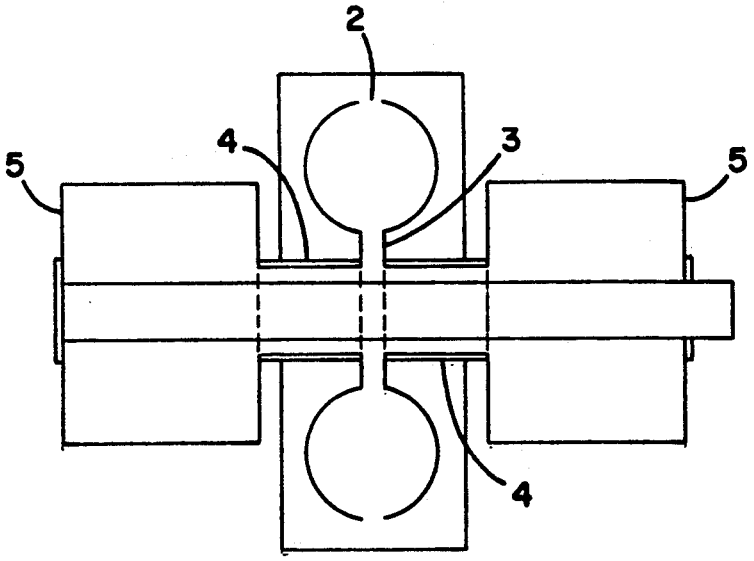
Figure 4:
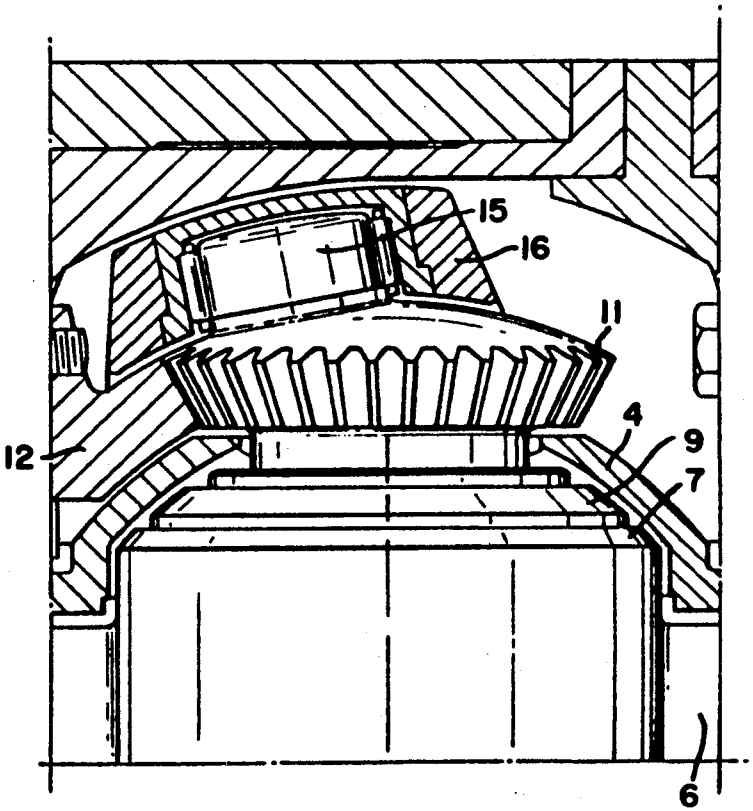
Figure 3:
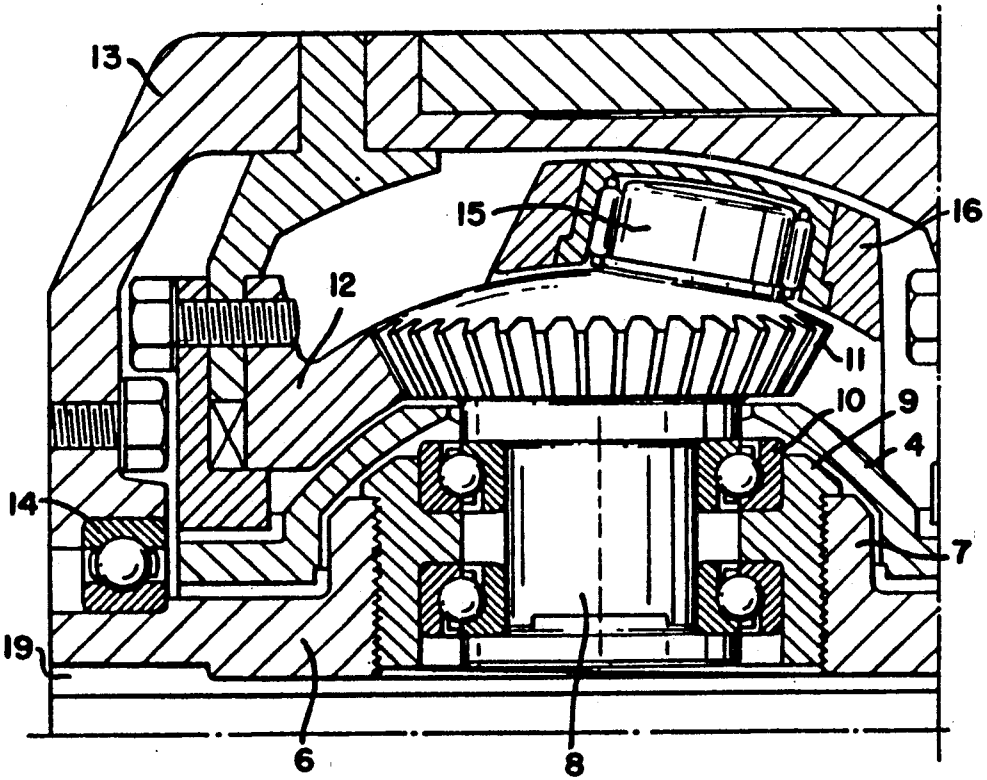
Figure 6:
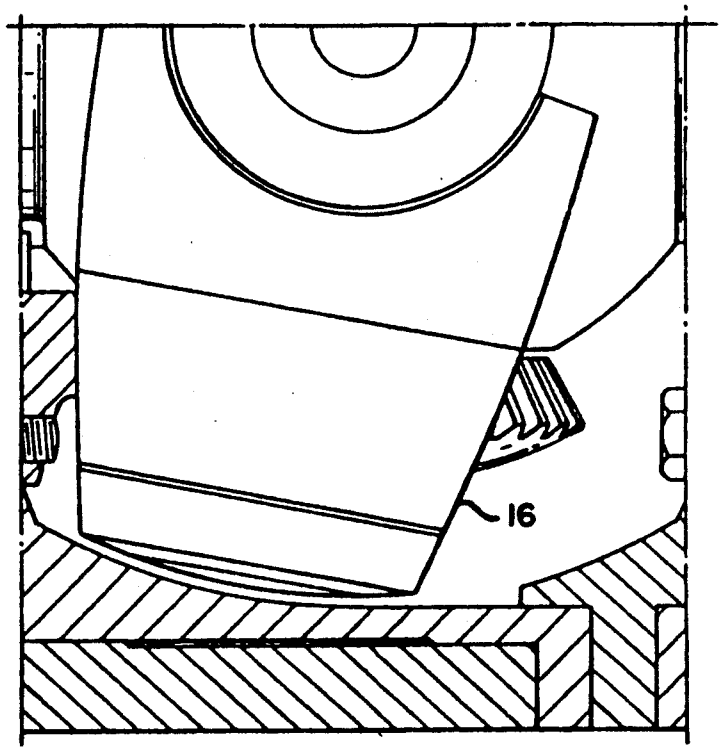
Figure 5:
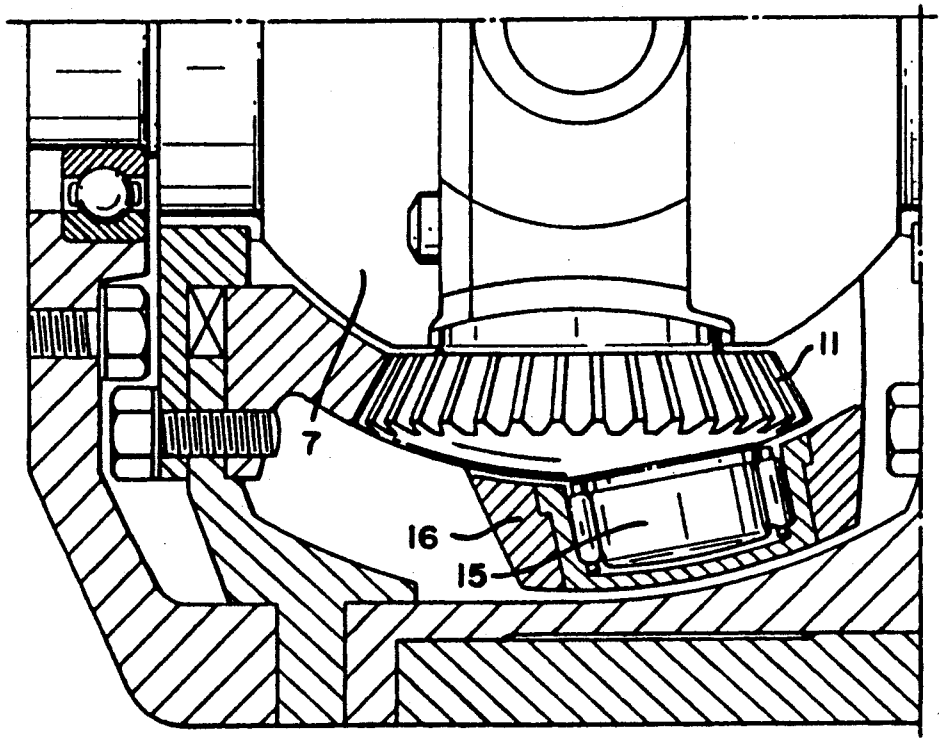
Figure 8:
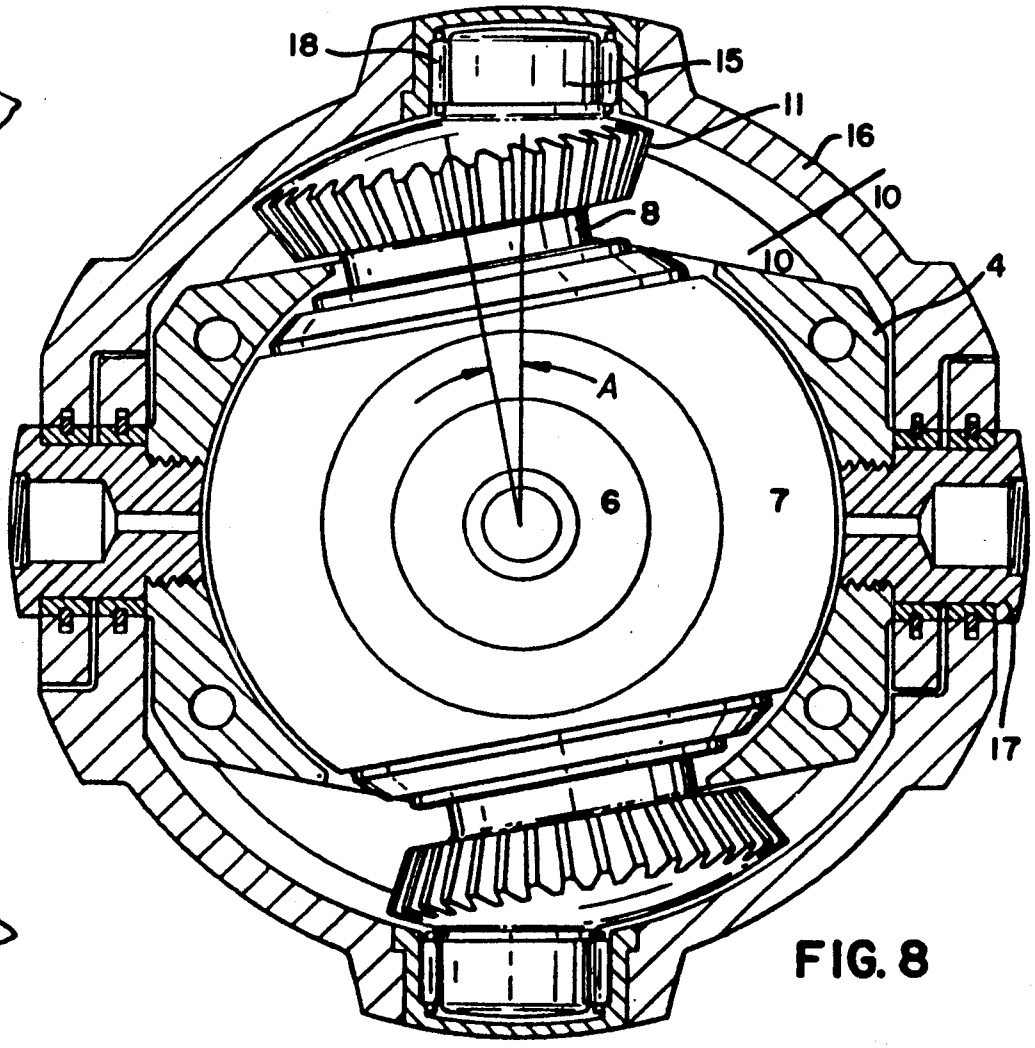
Figure 7:
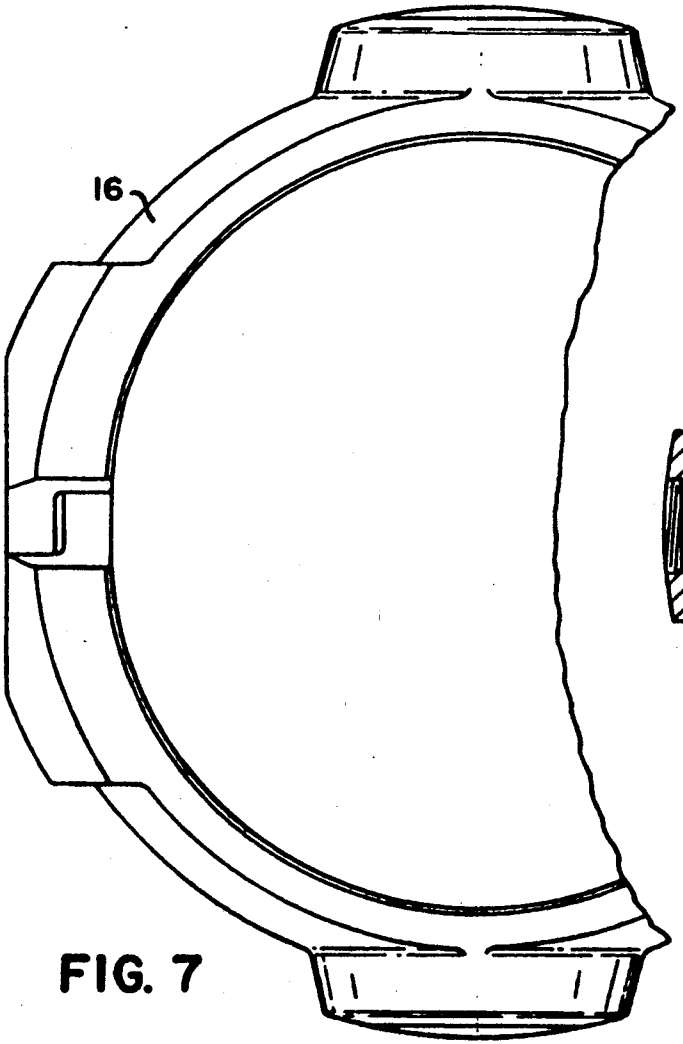
Figure 9:
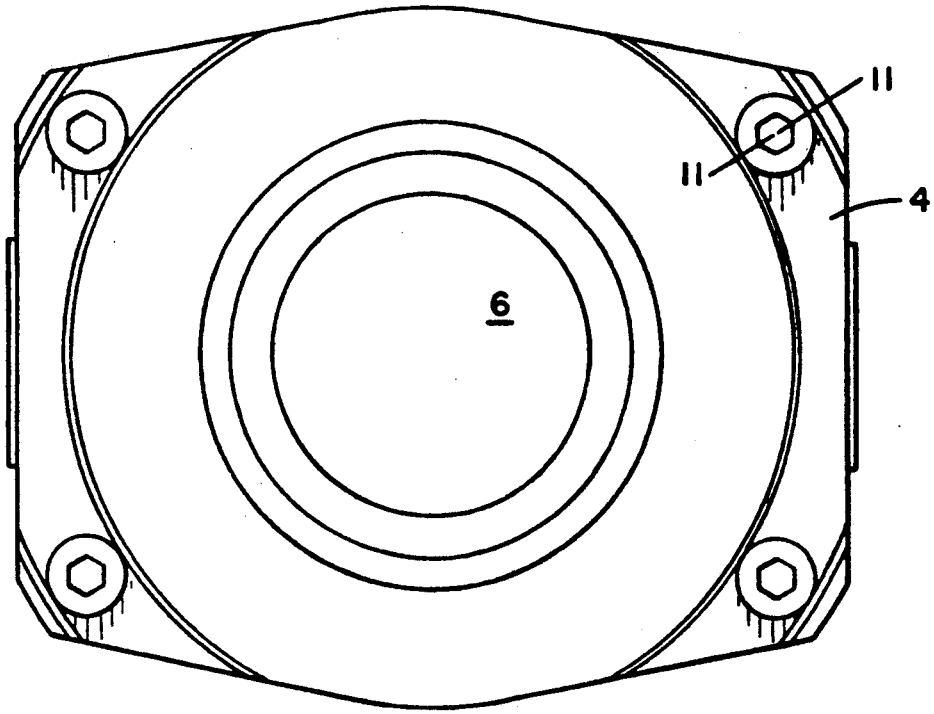
Figure 10:
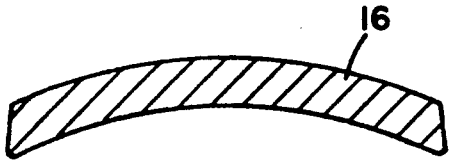
Figure 11:
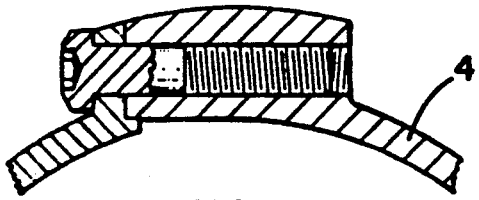

For a better understanding of the invention and as to how the same may be carried into effect, reference will now be made, by way of example, to the accompanying drawings in which:

FIG. 1 shows diagrammatically the pistons of a four piston alternating velocity rotary engine, mounted in a toroidal channel, viewed along the engine main shaft, FIG. 2 is a schematic side view of the engine, FIGS. 3 to 6 show longitudinal part-sections of two alternating velocity mechanisms employed in the engine, FIG. 3 being a section through a drive element or stub shaft forming part of a first alternating velocity mechanism, FIG. 4 being a section through a second alternating velocity mechanism showing the outside of the engine main shaft, FIG. 5 being a further part-section showing the outside of a piston shaft extension as will be described, of the first mechanism and FIG. 6 being a further part-section showing a semicircular connecting arm, as will also be described, of the second mechanism, FIG. 7 shows an external view along the longitudinal axis of the engine main shaft, of two connecting arms of an alternating velocity mechanism, FIG. 8 is a cross-sectional view, along the longitudinal axis of the engine main shaft of one alternating velocity mechanism, FIG. 9 is an external view along the longitudinal axis of the engine main shaft of an annular piston shaft extension, FIG. 10 is a longitudinal section taken along the line 10—10 in FIG. 8 of a semicircular connecting arm, FIG. 11 is a part-section taken along the line 11—11 in FIG. 9, showing the manner in which the two parts of the annular piston shaft extension are bolted together, and FIGS. 12A–12G illustrate the movement of the pistons, rotors and corresponding drive elements over three quarters of a turn of a drive element rotation about its axis.

Referring to FIG. 1, the engine as shown comprises four pistons 1 arranged in a common toroidal channel 2, the pistons 1 being disposed in two pairs with the pistons of each pair being mounted on a common rotor 3*a* or 3*b* as shown.

Referring to FIG. 2, each rotor 3*a* or 3*b* incorporates an annular piston shaft extension 4 which is led to an alternating velocity mechanism 5 rotatably mounted on the said engine shaft 6.

Referring now to FIGS. 3–6, the main shaft 6 is formed with an enlargement 7 for each alternating velocity mechanism 5 in which are mounted two diametrically opposed rotary drive shafts 8, rotatable on axes radially extending from the axis of rotation of the engine main shaft 6. Each rotary drive shaft 8 is arranged in a bearing assembly 9 including two thrust bearings 10, and carries a drive bevel gear 11.

The two rotary drive bevel gears 11 engage with a stator or fixed crown wheel 12 which is bolted to a main housing 13 incorporating bearings 14 for the main shaft 6, the gear ratio between the stator 12 and the bevel gears 11 being 2:1. During rotation of the shaft 6 as will be described, the bevel gears 11 roll around the stator 12.

Each bevel gear 11 carries an eccentrically mounted drive pin or stub shaft 15 and each stub shaft 15 rotatably engages with a semicircular connecting arm 16 to form a pivot. In the preferred embodiment, the drive pin 15 engages the semi-circular connecting arm 16 through a roller bearing 18 as shown in FIG. 8. The two connecting arms 16 link up together on two common fulcrum members 17, as shown in FIG. 8. Referring to FIGS. 8–10, annular piston shaft extension 4 which, as will be seen from FIG. 3, envelops the enlargement 7 of the main shaft, is split, as shown in FIG. 11, to enable assembly of this component to take place and being apertured to fit around the two opposed rotary drive shafts 8.

Rotation of the main shaft 6 causes the rotary bevel gears 11 to roll around the stator 12 and this, of course, causes the stub shafts 15 to execute oscillatory movement about the main shaft axis, the component of angular velocity tangential to the direction of the main shaft rotation being composed of simple harmonic motion superimposed upon steady angular rotation, the bevel gears 11 executing two turns about their respective centres for each complete rotation of the whole assembly about the longitudinal axis of the main shaft. Here it should be pointed out that the alternating velocity mechanisms 5 must have been assembled so that the angular positions of the two stub shafts 15 of each alternating velocity mechanism would correspond at any instant. If the stator were considered as a linear rack the two bevel gears would engage the rack at spaced locations along its length, that would also correspond at any instant. This is illustrated in FIGS. 3 and 5 for one alternating velocity mechanism and FIGS. 4 and 6 for the other alternating velocity mechanism.

Still considering the one mechanism, movement of the stub shafts 15 resolved parallel to the longitudinal axis of the main shaft 6 is simply taken up by the fulcrums 17 but, resolved circumferentially, movement of the stub shafts 15 causes the piston shaft extension 4, rotating around the shaft 6 with an average angular velocity $V_m$, to oscillate backwards and forwards whilst it is rotated, causing the two pistons periodically to accelerate to a maximum angular velocity and then to decelerate to a minimum angular velocity, twice per revolution of the whole alternating velocity mechanism.

Consider now the other pair of pistons and their respective alternating velocity mechanism. This, however, is arranged, so that the stub shafts of this mechanism are 180° displaced in position from that of the stub shafts of the other mechanism, again as illustrated in FIGS. 3 and 5 for one alternating velocity mechanism and FIGS. 4 and 6 for the other alternating velocity mechanism. On the other hand, the stators 12 of the two mechanisms are on the same side. Referring also to FIG. 12, rotation of the main shaft will cause both piston rotors 3*a* and 3*b* to execute alternating velocity in the sense that when one reaches maximum velocity, the other reaches minimum velocity and vice versa. This movement is known as a "cat and mouse" movement.

Figures 12A, 12B, 12C, 12D, 12E, 12F, 12G:
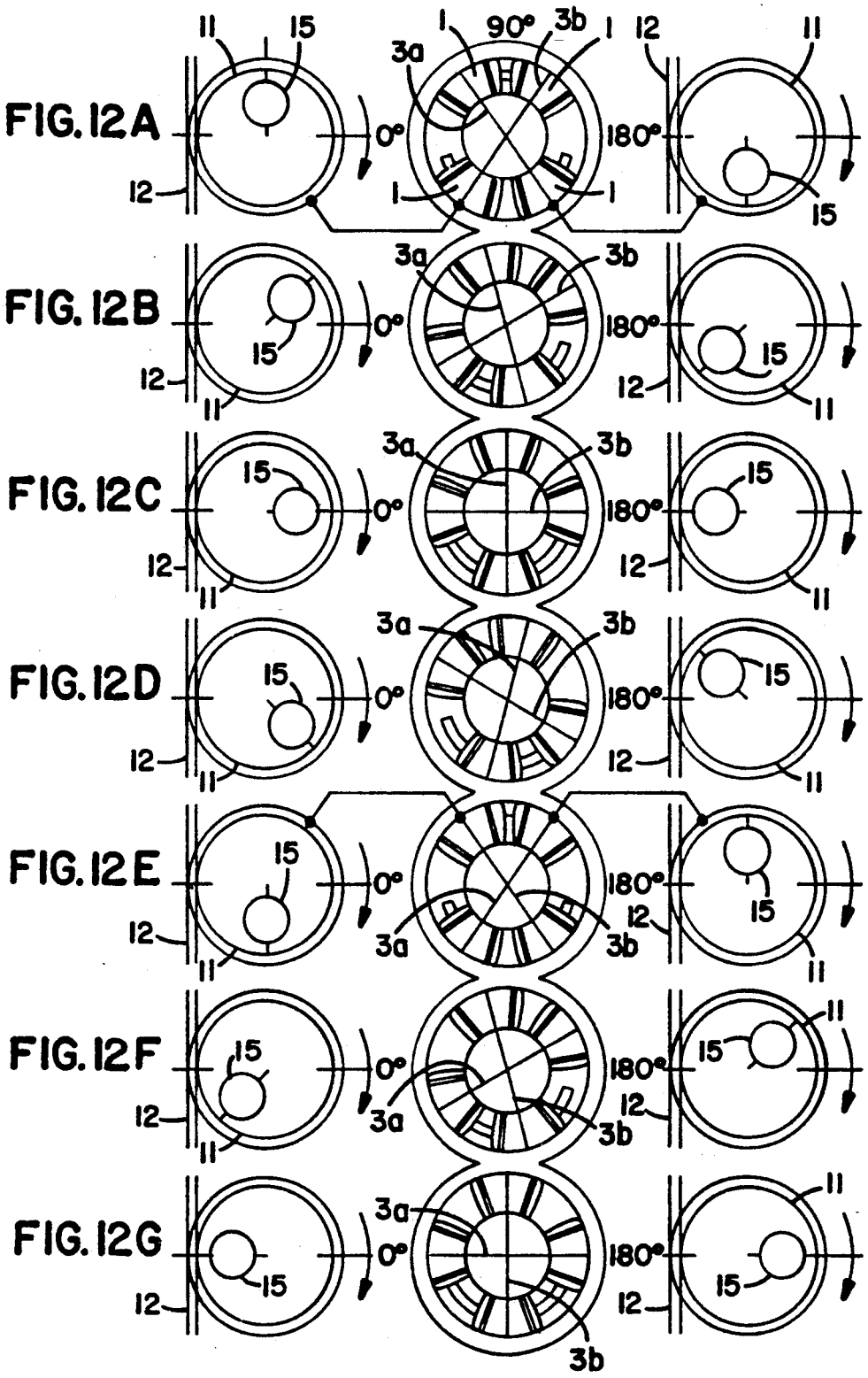

As depicted in FIG. 12A, the pistons 1 of rotors 3*a* and 3*b* compress a combustible mixture at the top FIG. 12A. After ignition, rotor 3*b* has positive acceleration while rotor 3*a* has negative acceleration (see FIG. 12B). Rotor 3*b* reaches its maximum angular velocity at the position depicted in FIG. 12C while rotor 3*a* has its minimum velocity at the same time. Rotor 3*b* has negative acceleration in FIGS. 12D–12F while in FIG. 12F rotor 3*a* has positive acceleration due to ignition in the pocket between rotors 3*a* and 3*b* at the top of FIG. 12E. As such, rotors 3*a* and 3*b* (and their respective pistons 1) rotate in a manner that one rotor is always "chasing" the next with varying levels of acceleration and deceleration.

The extent to which angular velocity varies from that of the main shaft is determined by the angle A (FIG. 8) subtended between the axis of each stub shaft and that of the bevel gear on which it is mounted. A typical value for the angle A would be 11° giving a maximum piston velocity $V_P$ of $(1+2 \tan A)\ V_m$ or $1.4\ V_m$ where $V_m$ is the engine main shaft velocity and a minimum piston velocity $V_P$ of $(1-2 \tan A)\ V_m$ or $0.6\ V_m$. With increasing values of the angle A there can be achieved greater angular displacements and angular velocities.

To define the complete formula for the angular velocity of each connected pair of pistons, let $T = \tan A$, let $Vm$ = the angular velocity of the engine main shaft, and let $\theta$ = the angle of main shaft rotation.

In which case, if 0° lies on the horizontal axis—see FIG. 1—then the formula is as follows:

$$V_p/V_m = 1 + 2T\cos 2\theta/(1+(T\sin 2\theta)^2)$$

based in turn on the differential of: $\theta + \tan^{-1}(T \sin 2\theta)$

The point at which the velocity of the main shaft coincides with that of all four pistons equals the point at which all their radial centre lines have an angular distance of $(45+A)°$ from the horizontal axis—i.e., when the all the gaps between the pistons are at maximum variance.

Of course, as is well known, the combustion engine will be provided with a fuel inlet and an exhaust outlet and means for igniting the charge (if the engine is a spark ignition engine) and the main shaft, having been rotated by auxiliary means for starting purposes, will be driven by the pistons in the normal way.

The mechanism for driving the main shaft from the pistons as described above provides an efficient and more reliable mechanism than hitherto. In particular the use in each alternating velocity mechanism of a) the three bevel gears (two rotary drive gears 11 and the stator 12)

b) the two semicircular connecting arms 16, c) the annular piston shaft extension 4, and d) a spherical main shaft section, enables all seven components to have spherical surfaces with a common centre point on the main shaft axis, giving a very compact spherical arrangement. Also the disposition of the stator 12 on the one side, in each case, and the 180° displacement of the stub shafts of the one alternating velocity mechanism in relation to the other mechanism results in the combination of the two mechanisms being dynamically balanced in the direction radial to the axis of the rotation of the main drive shaft.

Advantageously the main shaft 6 may be provided with a longitudinal bore 19 as shown in FIG. 3 to receive a high tensile steel tube to act as a tie bolt to assist in securing the main shaft in position in the housing 13 and to contain the forces generated by the engine. This may also serve as a coolant duct.

It is further desirable to form the main shaft in two parts which are enclosed in a bearing sleeve around which the two separate piston shafts are free to oscillate. A straightforward dog-coupling inside the centre of the sleeve may couple the drive shaft sections together.

More importantly as will be seen from FIG. 12A–12G ignition of the charge takes place at an instant when, having regard to the positions of the stub shafts 15, stress on the gear teeth will be minimised. Rotation of the combustion engine as described above continues on account of the explosive driving force of the charge taking place when the moment of the stub shaft connected to the accelerating combustion piston is greater than the moment of the stub shaft connected to the decelerating piston about the respective contact points on the stationary crown wheel.

I claim:

1. An alternating velocity rotary engine comprising a central mainshaft, a toroidal channel disposed about said mainshaft, a pair of pistons located in said channel, and two alternating velocity mechanisms located on opposite sides respectively of the channel, each connecting a respective piston to the mainshaft, each mechanism employing for its respective piston, a stationary gear disposed about said mainshaft, a pair of rotary drive gears which rotate on an axis extending radially from the mainshaft and which both cooperate with the stationary gear, an eccentrically mounted drive element on each rotary drive gear and a pair of connecting arms drivingly connecting the piston to the drive elements, each of the connecting arms being rotatably connected to a respective drive element and extends to, and is rotatably connected to, the piston, each connecting arm of each mechanism and the connecting arms of the two mechanisms being of substantially the same dimensions.

2. An alternating velocity rotary engine as set forth in claim 1, in which the engine includes two pairs of pistons and the pistons of each pair are mounted on a common rotary connected to one of the respective alternating velocity mechanisms.

3. An alternative velocity rotary engine as set forth in claim 1, in which the connecting arms of each alternative velocity mechanism are connected to the associated piston through a piston shaft extension surrounding the main shaft and the rotary gears are mounted in an enlargement of the mainshaft, the stationary gear, the drive gears, the piston shaft extension and the mainshaft enlargement having spherical surfaces with a common center point on the mainshaft axis.

4. An alternating velocity rotary engine as set forth in claim 1, in which each drive gear of each alternating velocity mechanism comprises a bevel gear and the stationary gear comprises a crown wheel.

5. An alternating velocity rotary engine as set forth in claim 1, in which each drive element comprises a drive pin.

* * * * *